US008089328B2

(12) United States Patent
Bizien et al.

(10) Patent No.: US 8,089,328 B2
(45) Date of Patent: Jan. 3, 2012

(54) ELECTRONIC SWITCHING DEVICE FOR HIGH-FREQUENCY SIGNALS

(75) Inventors: Michel Bizien, Milizac (FR); Pascal Cornic, Brest (FR); Jean-Philippe Coupez, Le Relecq Kerhuon (FR); Julien Boucher, Commana (FR); Jérémie Hemery, Tourc'h (FR)

(73) Assignees: Thales (FR); Groupe des Ecoles des Telecommunications/Ecole Nationale Superieure des Telecoms Bretagne (FR)

( * ) Notice: Subject to any disclaimer, the term of this patent is extended or adjusted under 35 U.S.C. 154(b) by 270 days.

(21) Appl. No.: 12/581,540

(22) Filed: Oct. 19, 2009

(65) Prior Publication Data

US 2010/0097120 A1 Apr. 22, 2010

(30) Foreign Application Priority Data

Oct. 17, 2008 (FR) ..... 08 05764

(51) Int. Cl.
*H01P 1/10* (2006.01)
*H01P 1/15* (2006.01)

(52) U.S. Cl. ..... 333/101; 333/104

(58) Field of Classification Search ..... 333/101, 333/103, 104

See application file for complete search history.

(56) References Cited

U.S. PATENT DOCUMENTS 5,193,218 A * 3/1993 Shimo ..... 455/80
7,391,283 B2 * 6/2008 Kearns ..... 333/103

* cited by examiner

*Primary Examiner* — Dean O Takaoka
(74) *Attorney, Agent, or Firm* — Baker & Hostetler, LLP

(57) ABSTRACT

The invention relates to an electronic switching device for high-frequency signals. The invention is of particular use in the connection between a microwave frequency antenna and an electronic circuit. This circuit comprises one or two access points designed to be connected to the antenna forming a third access point. In the case of a switch between one access point and the antenna (called an SPST switch), it comprises two switching diodes, one, called a serial diode, being connected in series between the access points and the other, called a shunt diode, between one of the access points and an earth of the device. According to the invention, a first transmission line is placed in series with the shunt diode, a second transmission line is placed in series with the serial diode, a third transmission line is placed at the common point of the first transmission line and of the shunt diode, a fourth transmission line is placed at the first access point, and a fifth transmission line is placed at the second access point. For a switch with three access points, two other diodes and four other transmission lines are added in a symmetrical manner relative to those already described. It is possible to obtain adapted lines having lengths much shorter than λ/4, which makes it possible to improve the compactness of the device while increasing its bandwidth.

10 Claims, 3 Drawing Sheets

ELECTRONIC SWITCHING DEVICE FOR HIGH-FREQUENCY SIGNALS

CROSS-REFERENCE TO RELATED APPLICATIONS

This application claims priority of French application no. FR 08/05764, filed Oct. 17, 2008, the disclosure of which is hereby incorporated by reference in its entirety.

BACKGROUND OF THE INVENTION

The invention relates to an electronic switching device for high-frequency signals. The invention is of particular use in the connection between a microwave frequency antenna and an electronic circuit. This circuit comprises for example one or two channels designed to be connected to the antenna. In the case of two channels, a first channel, usually called the Tx channel, uses the antenna in transmit mode and a second channel, usually called the Rx channel, uses the antenna in receive mode.

A device with two access points used as a switch is well known in the literature under the name of SPST for "Single-Pole, Single-Throw" and a device with three access points used as a switch is well known under the name of SPDT for "Single-Pole, Double-Throw".

For microwave frequency uses, it is known practice to use as a switching element, diodes comprising an undoped zone, called an intrinsic zone, inserted between doped zones, one positive and the other negative. In the rest of the description, this type of diode will be called a PIN diode, with reference to its name in the literature: "Positive Intrinsic Negative diode". PIN diodes, reverse biased, have a low capacitance and a high breakdown voltage, while, when forward biased, they have a very low resistance, hence their use in microwave switching.

SPST switching devices have been perfected that comprise two PIN diodes, one, called a serial diode, being connected in series between two access points and the other, called a shunt diode, between one of the points and an earth of the device which also comprises means for biasing the diodes, making it possible to define an on state of the device obtained when the serial diode and the shunt diode are in an on state, and an off state of the device obtained when the serial diode and the shunt diode are in an off state. The connection between the two access points is called a serial branch and the connection between the first access point and the earth is called a shunt branch. The serial branch contains the serial diode and the shunt branch contains the shunt diode.

For an SPDT switching device, four PIN diodes are used, two serial diodes and two shunt diodes. These devices have good performance in terms of adaptation, insertion losses and isolation.

Nevertheless, the existence of electrical interference elements, be they intrinsic to the PIN diodes themselves or associated with the installation of the components of the device on a printed circuit, does not make it possible to obtain optimal levels of insertion losses and isolation.

In order to alleviate this problem, a section of transmission line has been placed in series with each shunt diode. This section is adapted according to the wavelength of the switched signal. A section with a length $\lambda/4$, or even slightly less than this value, is chosen so that the section associated with the shunt diode has a length equivalent to $\lambda/4$. However, the tuning of the transmission line section limits the pass bandwidth of the device because of the length equivalent to $\lambda/4$.

SUMMARY OF THE INVENTION

The present invention improves the operation of such devices, notably by improving its pass bandwidth. This is achieved by avoiding installing a shunt branch with a length equivalent to $\lambda/4$.

Accordingly, the subject of the invention is an electronic switching device for high-frequency signals between at least two access points and comprising two switching diodes, one, called a serial diode, being connected in series between the access points, and the other, called a shunt diode, between one of the access points and an earth of the device, means for biasing the diodes making it possible to define an on state of the device obtained when the serial diode and the shunt diode are in an on state, and an off state of the device obtained when the serial diode and the shunt diode are in an off state, the device being characterized in that it comprises:

- a first transmission line placed in series with the shunt diode,
- a second transmission line placed in series with the serial diode,
- a third transmission line placed at the common point of the first transmission line and of the shunt diode,
- a fourth transmission line placed at the first access point, and
- a fifth transmission line placed at the second access point.

The production of such a structure makes it possible to reduce the length of the various transmission lines, notably that of the shunt branch (first transmission line), and therefore the dimensions of a device using the invention.

BRIEF DESCRIPTION OF THE DRAWING

The invention will be better understood and other advantages will appear on reading the detailed description of an embodiment given as an example, a description illustrated by the attached drawing in which.

For purposes of clarity, the same elements will bear the same reference numbers in the various figures.

DETAILED DESCRIPTION OF THE PREFERRED EMBODIMENT

Figure 1:
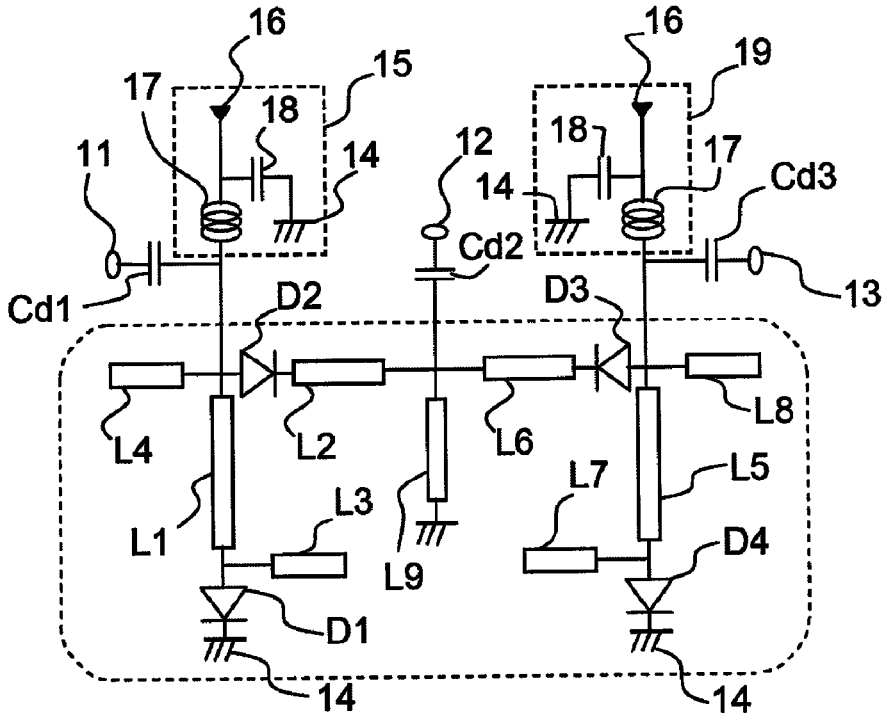
FIG. 1 represents schematically an SPDT device.

FIG. 1 represents an SPDT switch making it possible to connect to an antenna, either an Rx channel, or a Tx channel. Accordingly, the device comprises three access points 11, 12 and 13. Access point 11 is connected to a transmitter, thereby forming the Tx channel, the access point 12 is connected to an antenna and the access point 13 is connected to a receiver, forming the Rx channel. The transmitter, the receiver and the antenna are external to the device and are not shown in FIG. 1. A radio frequency signal originating from the transmitter attacks the switch via a decoupling capacitor Cd1. Similarly a radio frequency signal received by the antenna attacks the switch at the access point 12 via a decoupling capacitor Cd2 and leaves the switch at the access point 13 via a decoupling capacitor Cd3.

The switch is symmetrical relative to the access point 12, designed to be connected to the antenna. The switch makes it possible to connect either the access point 11 or the access point 13 to the access point 12. To connect the access point 11 to the access point 12, the switch comprises a diode D1, called a shunt diode, connected between the access point 11, on its anode side, and an earth 14 of the switch, on its cathode side, and a diode D2, called a serial diode, connected in series between the access point 11, on its anode side, and the access point 12 on its cathode side. Means 15 for biasing the diodes D1 and D2 make it possible to define an on or off state between the channels 11 and 12. The biasing means 15 comprise, for example, a voltage source 16 filtered by an inductor 17 and a capacitor 18. The inductor 17 is connected between the voltage source 16 and the access point 11. The capacitor 18 is connected between the voltage source 16 and the earth 14. The voltage source 16 may have two levels. A low level stops a current from flowing in the diodes D1 and D2, while a high level turns on the diodes D1 and D2.

Similarly, the switch comprises a diode D4 called a shunt diode, connected between the access point 13 and the earth 14 and a diode D3 called a serial diode, connected between the access point 13 and the access point 12. Means 19 for biasing the diodes D3 and D4, identical to the biasing means 15, make it possible to define an on or off state between the channels 12 and 13.

According to the invention, the switch comprises several sections of transmission lines placed at precise locations in the switch. The transmission lines are designed so that combining the electric effects of the serial and shunt branches with that of the common branch on the access point 12 produces, on the one hand, the lowest possible reflection level and the minimum insertion losses on one of the channels Tx or Rx in the on state, associated, on the other hand, with the highest possible level of isolation on the other channel in the off state.

It is noted that a good adaptation makes it possible to obtain lengths of the various transmission lines that are considerably shorter than $\lambda/4$, which makes it possible to increase the bandwidth of the switch. More precisely, the switch comprises:

- a first transmission line L1 placed between the first access point 11 and the shunt diode D1,
- a second transmission line L2 placed between the serial diode D2 and the second access point 12,
- a third transmission line L3 placed at the common point of the first transmission line L1 and of the shunt diode D1,
- a fourth transmission line L4 placed at the first access point 11, and
- a fifth transmission line L9 placed at the second access point 12.

In the rest of the description, the assembly formed by the shunt diode D1, the first transmission line L1 and the third transmission line L3 will be called the shunt branch. Similarly, the assembly formed by the serial diode D2 and the second transmission line L2 will be called the serial branch.

To connect the access point 13, the switch has other transmission lines that are symmetrical with the lines L1 to L4 in each of the branches comprising the diodes D3 and D4. More precisely, a transmission line L5 is placed between the access point 13 and the shunt diode D4, a transmission line L6 is placed between the serial diode D3 and the second access point 12, a transmission line L7 is placed at the common point of the transmission line L5 and of the shunt diode D4, a transmission line L8 is placed at the access point 13. There is also a transmission line L9 at the access point 12.

This arrangement increases the number of adaptation possibilities of the serial and shunt branches and makes it possible to more easily optimize all the electric performance of the switch. Moreover, the use of transmission lines with reduced dimensions allows greater compactness of the switch.

In the example shown, the transmission lines L3 and L4 are of the open circuit type. Similarly, the transmission lines L7 and L8 are also of the open circuit type. The transmission line L9 is of the short circuit type. In the literature, the transmission lines L3, L4 and L7 to L9 are known as stub lines.

The various transmission lines L1 to L9 advantageously have the same characteristic impedance that is, for example, 50 ohms.

Figure 2:
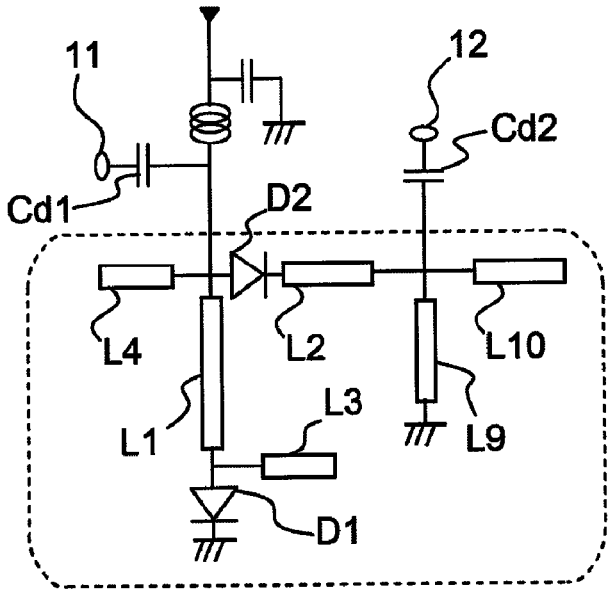
FIG. 2 represents schematically an SPST device.

The case of an SPST switching device, that is to say having only two access points, is shown in FIG. 2. This switch comprises only two access points similar to the points 11 and 12. In FIG. 2, the access points therefore have the same reference numbers 11 and 12 and there will also be the decoupling capacitors Cd1 and Cd2, the diodes D1 and D2 and the transmission lines L1 to L4. There is also the transmission line L9. A transmission line L10 of the open circuit type is placed at the common point of the transmission lines L2 and L9, that is to say at the second access point 12, in order to replace the whole of the Rx channel.

The operation of such devices, changeover or on-off switches, will now be explained by using a modelling of each switching diode which, in its on state (forward biased), is modelled in the form of a resistor $R_{diode}$ of low value, in series with a small inductor $L_{diode}$. In its off state (reverse biased), the diode is modelled in the form of a capacitor $C_{diode}$.

In a first case, the "Tx" channel is on and the "Rx" channel is isolated. In this case, through their directions of installation, the diodes D1 and D2 are both forward biased via the biasing means 15, and the diodes D3 and D4 are reverse biased through the biasing means 19.

The operation is described in detail only for the SPDT device with three access points. It is well understood that this operation can be transposed to the SPST device having only two access points 11 and 12. When the device is on between the access points 11 and 12, what is described for the Tx on channel is applied and, when the device is off between the access points 11 and 12, what is described for the Rx off channel is applied.

Figure 3:
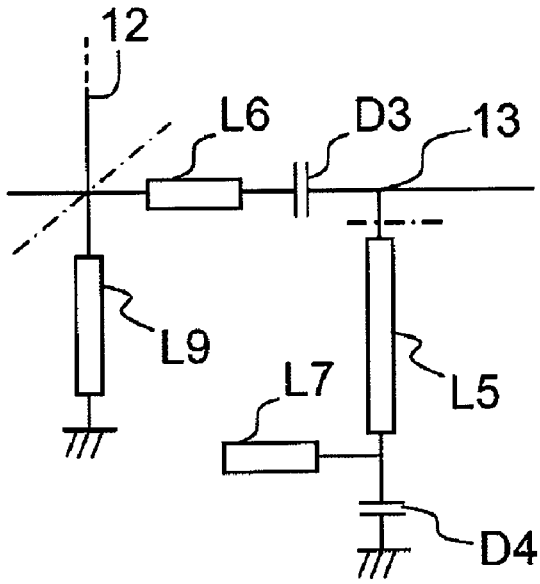
FIG. 3 represents a modelling of an isolated channel.

FIG. 3 represents a modelling of the isolated Rx channel without taking account of the decoupling capacitors Cd2 and Cd3. Only the transmission lines L5, L6, L7 and L9 are shown and the diodes D3 and D4 are shown as capacitors.

A high level of isolation on this channel is achieved by virtue, on the one hand, of the effect of the shunt branch with the diode D4 in the off state at its end, which brings to the aid of the transmission lines L5 and L7 the equivalent of a short circuit at the access point 13, at the operating frequency of the switch, and, on the other hand, to the resonant combination between the serial branch with the diode D3 in the off state and the transmission line L9 common with the Tx and Rx channels, which makes it possible to obtain, at this same frequency, the equivalent of an open circuit at the access point 12, when looking towards the Rx channel.

Moreover, it should be noted that, in this case, the transmission line L8 in open circuit and connected to the access point 13, in parallel with the shunt branch, has no electrical influence because this point is equivalent to a short circuit. The transmission line L8 is therefore not shown in FIG. 3.

More generally, the electrical states, open circuit at the point 12 and short circuit at the point 13, which provide an excellent level of isolation on the Rx channel, are therefore directly controlled by an appropriate choice of the lengths of the transmission lines L5, L6, L7 and L9. These lengths are all considerably less than λ/4. In particular, with respect to the length of the transmission line L7 in open circuit, mounted in parallel with the shunt diode D4, the latter forms an adjustment parameter which makes it possible very simply to fix the frequency for which the isolation level is optimal, by directly varying the length of the transmission line L7.

Figure 4:
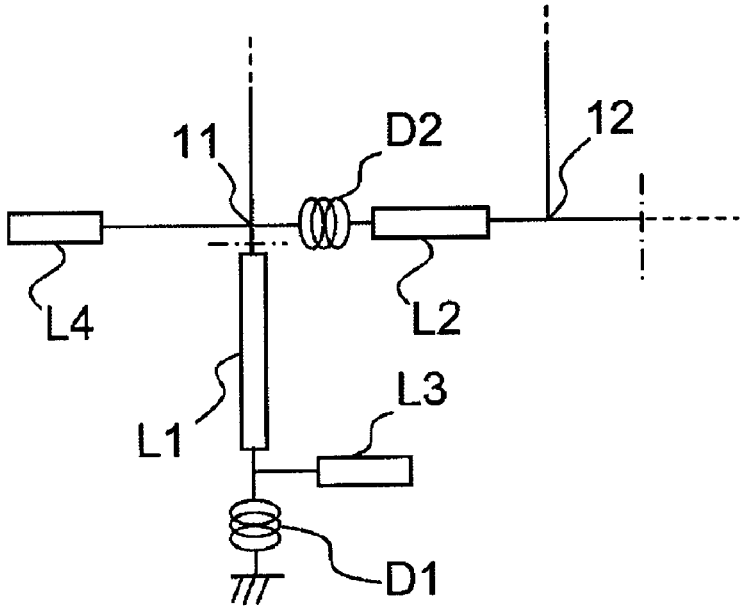
FIG. 4 represents a modelling of a pass channel.

FIG. 4 represents a modelling of the Tx channel in the on state without taking account of the decoupling capacitors Cd1 and Cd2. Only the transmission lines L1, L2, L3 and L4 are shown and the diodes D1 and D2 are shown as inductors.

Given the on state of the shunt diode D1, combined with the transmission lines L1 and L3 previously fixed to obtain a high level of isolation on the Rx channel, equal respectively to the transmission lines L5 and L7, the impedance brought by the shunt branch at the point 11 is close to that of an open circuit, nevertheless without always being strictly equal to a perfect open circuit. The shunt branch is therefore more or less transparent with respect to the transmission of the signal on the Tx channel. As for the diode D2 in the serial branch, the latter is also in the on state and cascaded with a transmission line of length L2, also fixed by the constraints of isolation on the Rx channel. In these circumstances, because of the low values of $R_{diode}$ and $L_{diode}$ and the characteristics of the transmission line L2, the transmission and reflection performances are sufficient on the Tx channel. However, in order to best optimize these performance levels, it is essential to alleviate the partial transparency of the shunt branch and the interfering influence of the electrical elements intrinsic to the diode D2 notably. To do this, a simple means consists in using the transmission line L4 connected in open circuit to the access point 11. The length of the transmission line L4 remains much shorter than λ/4. This transmission line L4 therefore forms an additional flexibility parameter in the structure of the switch, very easily adjustable in order to optimize the whole electrical performance.

In an SPDT switch, the two channels are symmetrical. The transmission lines L1 and L5 are identical. The same applies to the lines L2 and L6, L3 and L7 and to L4 and L8. It is therefore not necessary to explain in detail the operation of the situation in which the Rx channel is in the on state and the Tx channel is isolated. It is sufficient to invert the symmetrical elements.

Figure 5:
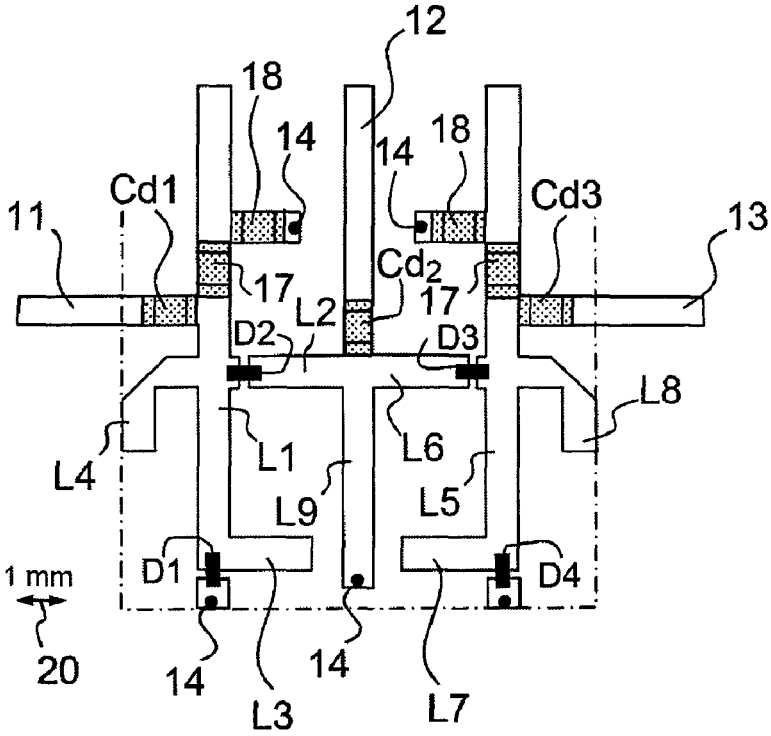
FIG. 5 represents an exemplary embodiment of an SPDT device in microstrip technology, the device schematized in FIG. 1.

FIG. 5 shows an exemplary embodiment of an SPDT device according to the diagram of FIG. 1, in microstrip technology and designed to operate in the X band, that is to say around a central frequency of 9.35 GHz. The shapes of the microstrips are shown on a scale bearing the reference number 20 in FIG. 5. It is well understood that other shapes of microstrips are possible to apply the invention. The configuration of the switch is based on a particular combination of several transmission lines with two PIN diodes on each of the channels. The lengths of all these transmission lines represent flexibility parameters making it easier to design the device, in particular to achieve a relatively large operating passband width of the switch.

The switch represented in the figure is produced on a substrate of thickness H=254 μm, with relative permittivity $\epsilon_r$=3.5, a loss tangent tgδ=3.5 $10^{-3}$ and a copper metallization thickness t=17.5 μm. For such a substrate, a characteristic 50Ω impedance transmission line has a strip width of the order of 540 μM, and the associated wavelength is λ=19.45 mm (hence λ/4=4.86 mm).

For the design of the circuit, it is possible to use a simulation software program such as, for example, "Advance Design System" marketed by Aligent Technologies in Santa Clara, Calif. (United States). The PIN diodes are, for example, modelled very simply in the form: either with a resistor $R_{diode}$=2.4Ω, in series with an inductor $L_{diode}$=0.25 nH, with forward bias, or with a capacitor $C_{diode}$=0.06 pF, in series with the previous inductor $L_{diode}$=0.25 nH, with reverse bias. Decoupling capacitors Cd1=Cd2=Cd3=4.7 pF have been added on each of the access points 11, 12 and 13 of the switch, as have bias filters: inductor 17 of 4.7 nH and capacitor 18 of 4.7 pF on the access points 11 and 13. The diodes, capacitors and inductors are for example surface-mount components on the substrate. It is possible to take account of the discontinuities of the microstrips provided for the mounting of the surface-mount components in the modelling.

In the designed circuit, the length of the longest transmission line corresponds to that of the transmission line L9 common to the Tx and Rx channels, the value of which is equal to 3.00 mm. Consequently, the lengths of the other transmission lines of the device are all much less than λ/4, which makes it possible to increase the bandwidth of the device and reduce the dimensions of its installation on the substrate. The transmission line L9 forms an axis of symmetry of the implementation of the device on its substrate. In the example shown in FIG. 5, the switch occupies a total effective surface area of only approximately 7.5×7 $mm^2$, including the surface-mount components.

The electrical characteristics originating from a simulation have given the following values: when the Tx channel is in the on state, the insertion losses are approximately 0.7 dB at the central operating frequency of 9.35 GHz, with matching that is less than −30 dB on the Tx access point and less than −32 dB on the access point 12. The level of isolation between the two channels Tx and Rx is, for its part, excellent since its value is approximately 60 dB. In addition, the electrical performance of the circuit remains correct over a relatively large bandwidth, the latter being of the order of 20% to 25% around the central frequency when considering, for example, matching levels not exceeding −20 dB.

Figure 6:
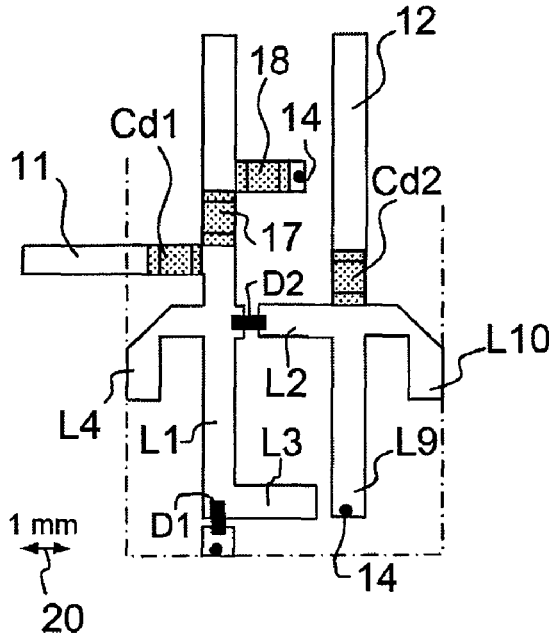
FIG. 6 represents an exemplary embodiment of an SPST device in microstrip technology, the device schematized in FIG. 2.

FIG. 6 shows an exemplary embodiment of an SPST device according to the diagram of FIG. 2. As above, this device is made in microstrip technology on the same type of substrate. It is designed to operate in the X band. The scale is also shown at reference number 20. In a simulation of this device carried out with the aid of the same software program, electrical performance was found equivalent to that of the SPDT device.

The insertion losses are of the order of 0.7 dB at the central frequency of 9.35 GHz, with matching levels which remain below −30 dB both at the input and the output of the SPST switch. Moreover, the electrical performance of the circuit remains correct on a bandwidth of more than 20% around the central frequency, with very few insertion loss variations and matching levels that do not exceed −20 dB on this band.

The switch occupies a total effective surface area of only approximately 5.5×7 $mm^2$, including the surface-mount components. In this instance, the same compactness is maintained as in the device of FIG. 5.

It will be readily seen by one of ordinary skill in the art that embodiments according to the present invention fulfil many of the advantages set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. An electronic switching device for high-frequency signals between at least two access points, comprising: two switching diodes, one, called a serial diode, being connected in series between a first and a second of the access points, and the other, called a shunt diode, between the first access point and an earth of the device, means for biasing the diodes making it possible to define an on state of the device obtained when the serial diode and the shunt diode are in an on state, and an off state of the device obtained when the serial diode and the shunt diode are in an off state, the device further comprising a first transmission line placed in series with the shunt diode, between the first access point and the shunt diode, a second transmission line placed in series with the serial diode, between the serial diode and the second access point, a third transmission line placed at the common point of the first transmission line and of the shunt diode, a fourth transmission line placed at the first access point, and a fifth transmission line placed at the second access point.

2. The device according to claim 1, wherein the third and fourth transmission lines are of the open circuit type.

3. The device according to claim 2, wherein the fifth transmission line is of the short circuit type.

4. The device according to claim 3, wherein it includes only two access points and further comprises a sixth transmission line of the open circuit type placed at the second access point.

5. The device according to claim 1, further comprising:

a third access point, a third switching diode and a fourth switching diode, the third, called a serial diode, being connected between the second access point and the third access point and the fourth diode, called a shunt diode, between the third access point and the earth, a seventh transmission line placed in series with the fourth diode called a shunt diode, between the third access point and the fourth diode called a shunt diode, an eighth transmission line placed in series with the third diode called a serial diode, between the third diode, called a serial diode and the second access point, a ninth transmission line placed at the common point of the third transmission line and the fourth diode, called a shunt diode, a tenth transmission line placed at the third access point.

6. The device according to claim 5, wherein the ninth and tenth transmission lines are of the open circuit type.

7. The device according to claim 1, wherein the transmission lines are designed so that, by combination of the electric effects in a branch called a serial branch containing the serial diode and in a branch called a shunt branch containing the shunt diode with that of a branch containing the fifth transmission line, produces, on the one hand, the lowest possible reflection level and the minimum insertion losses on a channel of the device in the on state, associated on the other hand, with the highest possible level of isolation on a channel of the device in the off state.

8. The device according to claim 1, wherein the various transmission lines have the same characteristic impedance.

9. The device according to claim 5, wherein the transmission lines are designed so that, by combination of the electric effects in a branch called a serial branch containing the serial diode and in a branch called a shunt branch containing the shunt diode with that of a branch containing the fifth transmission line, produces, on the one hand, the lowest possible reflection level and the minimum insertion losses on a channel of the device in the on state, associated on the other hand, with the highest possible level of isolation on a channel of the device in the off state.

10. The device according to claim 5, wherein the various transmission lines have the same characteristic impedance.

* * * * *